US005412911A

United States Patent [19]

Schlegel

[11] Patent Number: 5,412,911

[45] Date of Patent: May 9, 1995

[54] IN-FLOOR ACCESS PIT FRAME AND COVER SYSTEM

[76] Inventor: Gene C. Schlegel, 2723 R.D. #2, Mohnton, Pa. 19540

[21] Appl. No.: 138,289

[22] Filed: Oct. 15, 1993

[51] Int. Cl.[6] ..... E02D 29/14

[52] U.S. Cl. ..... 52/20; 404/25

[58] Field of Search ..... 52/19, 20, 169.6; 404/25, 26

[56] References Cited

U.S. PATENT DOCUMENTS 3,975,870 8/1976 Naka .
4,101,236 7/1978 Meyer .

FOREIGN PATENT DOCUMENTS 1249860 10/1971 United Kingdom .

OTHER PUBLICATIONS

Metaline Trench & Access Covers publication.

*Primary Examiner*—Carl D. Friedman
*Assistant Examiner*—Crighten Smith
*Attorney, Agent, or Firm*—Caesar, Rivise, Bernstein Cohen & Pokotilow, Ltd.

[57] ABSTRACT

An in-floor access pit unit for use in a floor having a flooring of a predetermined thickness thereon. The access pit basically comprises a rigid liner, a lower frame, an intermediate frame, a cover assembly, and a height adjusting mechanism. The cover assembly comprises an upper frame in which a cover plate is mounted to provide a recess for receipt of a piece of the same flooring material as on the floor in which the access pit is located. The cover assembly is mounted in the intermediate frame by the height adjusting mechanism. That mechanism comprises plural bolts and nuts for adjusting the height of the intermediate frame and the cover member so that the piece of flooring within the cover assembly is flush with the surrounding flooring. The intermediate frame includes a downwardly depending flange which is disposed closely adjacent a sidewall of the lower frame to prevent the ingress of material therebetween. A sealing gasket is provided between the cover assembly and the intermediate frame to prevent the egress of gases or fumes from the access pit.

10 Claims, 3 Drawing Sheets

FIG. 2
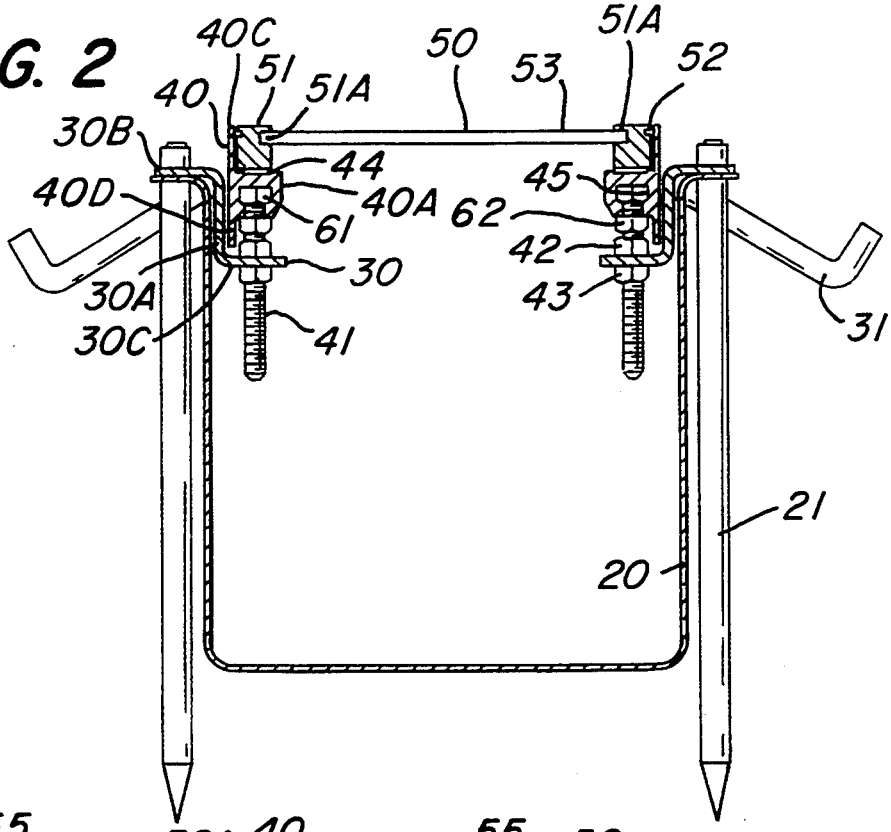
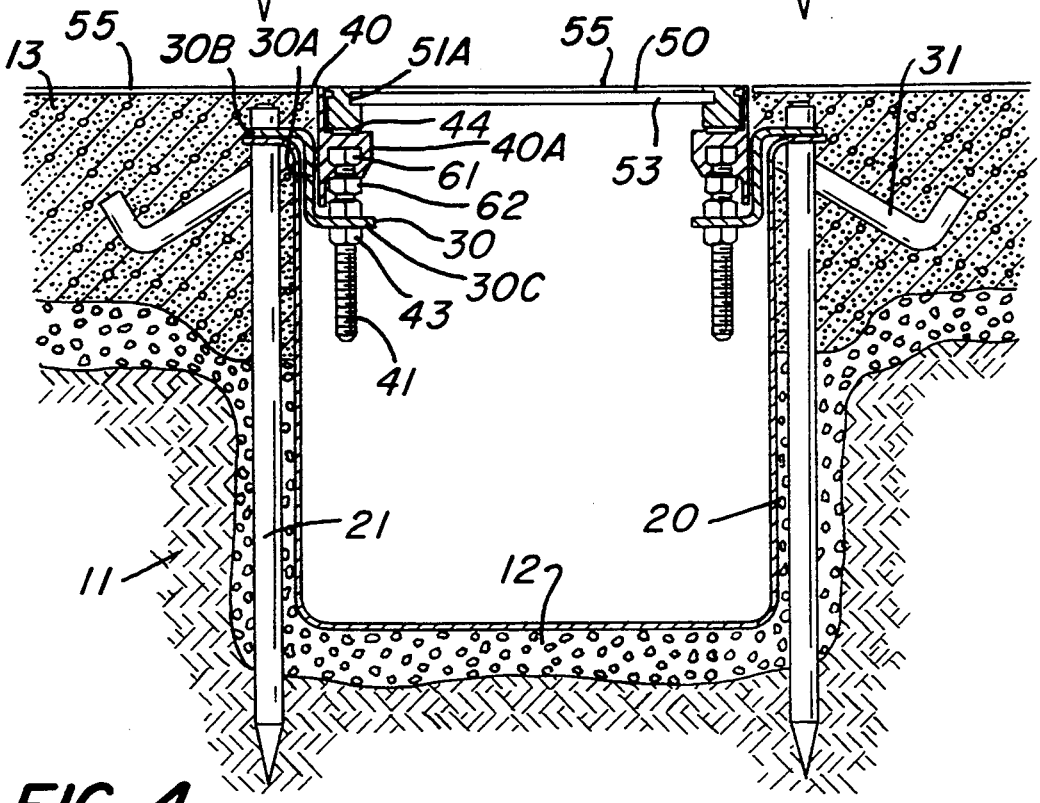
FIG. 4

FIG. 3A
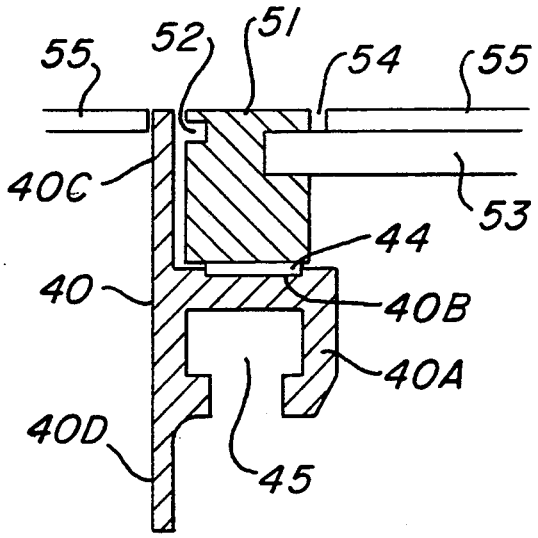
FIG. 3B
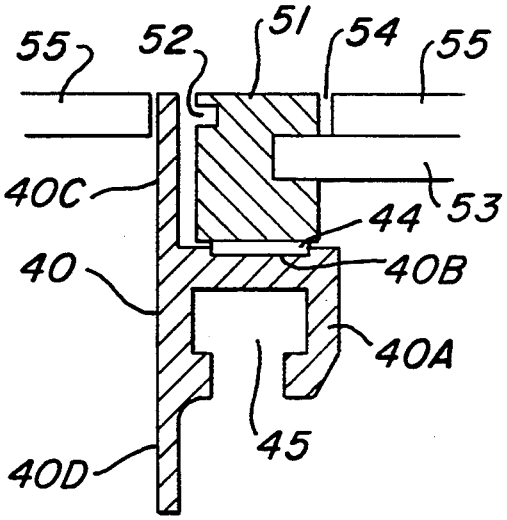
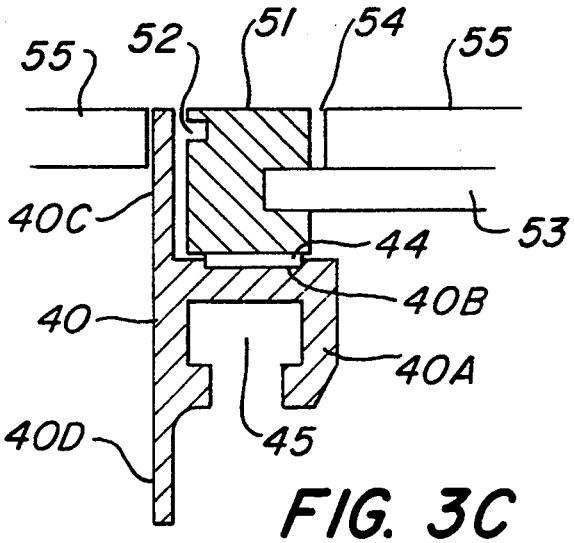
FIG. 3C
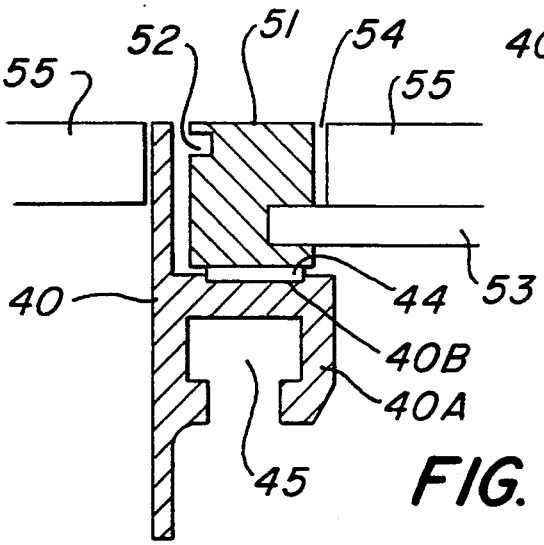
FIG. 3D

IN-FLOOR ACCESS PIT FRAME AND COVER SYSTEM

BACKGROUND OF THE INVENTION

This application relates to an improved In-floor Access pit system consisting of a frame, cover and liner to form a unit for permitting access into subtergrade voids where the primary use, but not limited to, electrical wiring, refrigeration piping, water piping, air ducts, and other mechanicals are located, and is a Continuation of my earlier application Ser. No. 07/867,406, filed on Apr. 13, 1992, entitled Improved In-Floor Access Pit Frame And Cover System, whose disclosure is incorporated by reference herein.

The prior art is typified by an in-floor access pit in supermarkets, convenience stores, and other retail establishments and the likes which are designed to provide needed access to under-floor mechanicals, particularly those adjacent to the refrigerated display fixtures where these mechanicals exist. The prior accepted practice for providing in-floor pits or voids was to construct on site as one of the schedule processes in the construction of the building. The construction of these access pits consists of materials such as concrete block or poured concrete with a steel top cover fitted to cover this opening in the concrete floor. Forming or constructing these access areas becomes laborious and time consuming, alignment of the steel top cover during installation was critical with respect to the final floor finish, and extended labor was exhausted in order to provide this within needed tolerance for an appealing finish. One such problem associated with the as mentioned alignment is floor finishing material such as vinyl tile, ceramic tile, quarry tile or the likes will tend to break along the edges when poor alignment is entailed.

OBJECTS OF THE INVENTION

It is a general object of this invention to provide an improved in-floor access pit which overcomes the disadvantages of the prior art.

It is another object of the invention to provide an in-floor access pit having an adjustable frame assembly that eliminates the continual problem of the alignment causing the finish floor covering material to have less than accepted aesthetics.

It is another object of this invention to provide an in-floor access pit assembly which is constructed to expedite installation time and effort, and which eliminates the need for exactness during installation.

It is still another object of this invention to provide an in-floor access pit which offers effective adjustability of the frame during and after installation.

It is yet another object of this invention to provide an in-floor access pit which enables the final adjustment of the frame to match the tolerance of the floor finishing material.

It is yet another object of this invention to provide an in-floor access pit having a rigid water integrity liner that expedites installation and eliminates the need to field construct these pits or voids.

SUMMARY OF THE INVENTION

These and other objects of this invention are achieved by providing an access-pit unit for disposition within a hollow liner of a preformed pit in a floor having a covering thereon. The access-pit unit basically comprises an upper frame, an intermediate frame, a lower frame, a cover plate, and height adjustment means.

The lower frame is securable within the liner and has a sidewall including a vertically oriented portion having a hollow interior and an outer periphery corresponding to the interior periphery of the liner. The intermediate frame has a vertical upwardly depending flange and an aligned vertical downwardly depending flange, with the outer periphery of the aligned flanges corresponding to the hollow interior of the lower frame. The intermediate frame is disposed within the interior of the lower frame and is supported therein by the height adjustment means.

The height adjustment means us adjustable to adjust the vertical spacing between said intermediate frame and said lower frame.

The intermediate frame has a hollow interior including a horizontal support surface having a groove in which a gasket is located. The upper frame has a hollow interior corresponding to the periphery of the cover plate and an outer periphery corresponding to the interior space of the intermediate frame.

The upper frame is supported on the gasket within the interior of the intermediate frame, whereupon a fluid-tight seal is provided between the intermediate frame and the upper frame and wherein the downwardly depending flange of the intermediate frame is located immediately adjacent the vertical sidewall of the lower frame to prevent material from gaining ingress between the intermediate frame and the lower frame irrespective of the vertical spacing therebetween.

The cover plate is a planar member horizontally mounted within the interior of the upper frame to define a shallow recess in which a flooring panel having side edges may be disposed, so that the top surface of the flooring panel is flush with the floor covering.

DESCRIPTION OF THE DRAWINGS

Other objects and many attendant features of this invention will become readily appreciated as the same becomes better understood by reference to the following detailed description when considered in connection with the accompanying drawing wherein:

FIG. 2 is a vertical sectional view of the access pit shown in FIG. 1;

FIG. 3A is an enlarged sectional view of a portion of the upper frame assembly and cover shown constructed in accordance with this invention shown with the cover plate supporting a piece of flooring of a first predetermined thickness flush with the same flooring material covering the floor in which the access pit is located;

FIG. 3B is an enlarged sectional view of a portion of the upper frame assembly and cover constructed in accordance with this invention shown with the cover plate supporting a piece of flooring of a second predetermined thickness flush with the same flooring material covering the floor in which the access pit is located;

FIG. 3C is an enlarged sectional view of a portion of the upper frame assembly and cover shown constructed in accordance with this invention shown with the cover plate supporting a piece of flooring of a third predetermined thickness flush with the same flooring material covering the floor in which the access pit is located;

FIG. 3D is an enlarged sectional view of a portion of the upper frame assembly and cover shown constructed in accordance with this invention shown with the cover plate supporting a piece of flooring of a fourth predetermined thickness flush with the same flooring material covering the floor in which the access pit is located; and FIG. 4 is a vertical sectional view, like that of FIG. 2, but showing the in-floor access pit mounted in place within a floor of a building, with the floor being covered with a flooring material of a predetermined thickness.

DETAILED DESCRIPTION OF THE PREFERRED EMBODIMENTS

Figure 1:
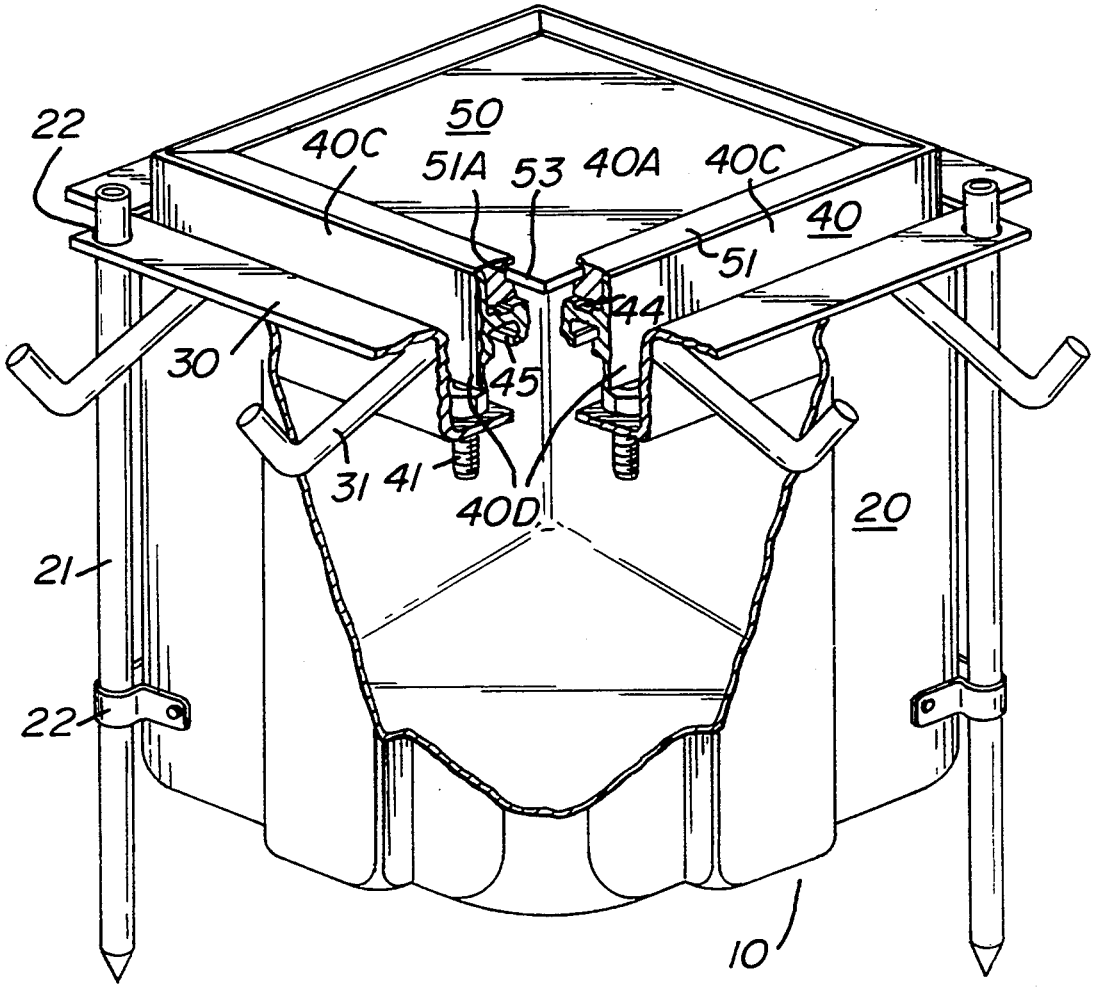
FIG. 1 is a isometric view, partially in section, of the access pit of this invention.

Referring now to various figures of the drawing where like reference numerals refer to like parts, there is shown in FIG. 1 an in-floor access pit unit 10 constructed in accordance with this invention. As can be seen in FIG. 4 the pit unit 10 is arranged to be disposed and mounted within fine aggregate or sand 12 placed below grade in earth 11 in a retail or commercial building floor having a floor covering material 55 of a predetermined thickness and tolerance thereon.

The pit unit 10 basically comprises a manufactured rigid liner 20, a lower frame 30, an intermediate frame 40, a cover assembly 50, and a height adjustment mechanism 41. The cover assembly 50 basically comprises an upper frame 51 and a top cover plate 53.

As can be seen clearly in FIGS. 1, 2, and 4, the lower frame 30 is an integral unit formed of any suitable material, e.g., metal, and is of square shape when view from the top, with each of its sides being an elongated member having a vertically oriented sidewall 30A. An upper horizontal flange 30B projects outward of the upper end of the sidewall 30A along the length thereof, and a lower horizontal flange 30C projects outward of the lower end of the sidewall 30A along the length thereof.

The intermediate frame 40 is also of square shape when viewed from the top, with each of its sides being an elongated extrusion of any suitable material, e.g., metal. As can be seen in FIGS. 3A–3D each side of the intermediate frame includes a mid-section 40A extending along the length thereof and having a horizontal upper support surface in which a horizontal recess 40B is located. A vertically oriented flange 40C projects upward from the outside of the mid-section 40A along the length thereof, while a vertically oriented flange 40D projects downward from the outside of the mid-section along the length thereof and flush with the flange 40B. An elongated recess or slot 45 is provided in the underside of the mid-section 40A of each side of the intermediate frame along the length thereof.

The upper frame 51 is also of square shape when viewed from the top, with each of its sides being an elongated extrusion of any suitable material, e.g., metal. A groove 51A (FIGS. 3A–3C) extends along each side of the upper frame for receiving the edge of the cover plate 53 therein.

The manufactured rigid liner 20 is placed into excavated earth at such depth as to allow open access from above to secure the liner in place until the sand 12 is placed and concrete floor 13 is poured. Plural securing rods 21 are placed through guides 22 and are driven into the earth 11.

The lower frame 30 supports the intermediate frame 40, via the adjustment mechanism 41, while the intermediate frame directly supports the top frame 51 and the cover plate 53 thereon. Plural concrete anchor pins 31 are provided to secure the lower frame 30 into the concrete 13. Thus, the lower frame 30 accepts the bearing load of the intermediate frame 40, the top frame 51, and the cover plate 53, and relieves any load born on the liner 20.

As mentioned earlier the intermediate frame 40 is an extruded member having a support surface including a recessed channel 40B therein. That channel holds a perimeter gasket seal 44 therein. The top frame 51 is supported on the gasket 44.

The top frame assembly 40 mounts to the lower frame 30 via the adjustment mechanism 41. The adjustment mechanism basically comprises plural threaded bolts. Each bolt has a head 61 and three nuts 42, 43, and 62 mounted thereon. The head 61 of each bolt 41 is located within the slot 45 of the associated side of intermediate frame 40. The shank of each bolt extends through a respective hole (not shown) in lower horizontal flange 30C of the lower frame 30. The nut 63 on each bolt is located so that it is immediately below the mid-section of the associated side of the intermediate frame 40. The nut 42 on each bolt is mounted on top of the top surface of the inwardly projecting flange 30C of the associated side of the lower frame 30. The nut 43 on each bolt is mounted directly below the bottom surface of the inwardly projecting flange 30C of the associated side of the lower frame 30.

The top frame 51 and the cover plate 53 mounted therein form a cover assembly 50 for the unit 10. The top frame 51 is of such design to allow cover fabrication in several different offset combinations. By offset it is meant the distance of the groove 51A from the top or bottom surface of the top frame. With the cover plate 53 within the grooves 51A in the sides of the top frame 51 a recess 54 is provided in the top of the cover assembly. This recess is arranged for receipt of a square piece of the same flooring material 55 as used on the floor in which the access pit unit is located. When a piece of that flooring material is located within the recess 54 its edges will be protected from damage by the flush upper surface of the top frame 51 as shown clearly in FIGS. 3A–3D.

To allow for ease in removal of the cover assembly 50 a slot 52 is provided around the full perimeter of the top frame 51 to accept a prying tool or device.

The adjustment mechanism 41 allows vertical alignment of the top frame 40 to comply to the needed thickness and tolerance of standard floor covering material 55 used after all concrete work 13 is finished around the access pit unit 10. That adjustment is accomplished by rotating the bolts so that they move either up or down with respect to the lower frame, thereby carrying the upper frame and the cover plate to the desired height with respect to the lower frame. The nuts 62, 42 and 43 secure adjusting mechanism 41 after alignment is finalized.

As can be seen clearly in FIG. 4 the downwardly extending flange 40 is located immediately adjacent the vertical sidewall 30A of the lower frame 30 to prevent material, e.g., concrete, from gaining ingress between the intermediate frame 40 and the lower frame 30 irrespective of the vertical spacing therebetween as established by the height adjusting mechanism 41. Moreover, since the cover assembly 50 is supported directly on the gasket 44 located within the intermediate frame 40 a fluid tight seal results between the cover assembly upper frame 51 and the intermediate frame 40, thereby preventing the egress of gases or fumes from the interior of the access pit.

As should be appreciated from the foregoing the in-floor access pit system of this invention provides a voided space for the placement of mechanical components. The top frame assembly incorporates an adjustment design that permits the frame to move vertically to compensate for changes in finish floor elevations. The cover lid which fits into the frame assembly is designed in such a way that no mechanical securing devices are required to keep cover in place. The depressed surface on the cover's center area allows the floor covering material to be recessed which protects the integrity of the edges.

Without further elaboration the foregoing will so fully illustrate my invention that others may, by applying current or future knowledge, adapt the same for use under various conditions of service.

I claim:

1. An access pit assembly for disposition on a substrate for a floor located on the substrate, the floor having a floor covering thereon, the floor covering having a top surface, said assembly comprising:

a hollow liner, a lower frame, an intermediate frame, an upper frame, a cover plate, height adjustment means, and stand-alone securement means;

said hollow liner having a hollow interior defining an interior periphery and being arranged for disposition on a portion of the substrate and for securement thereto by said stand-alone securement means before the floor is located on the substrate, said liner having a peripheral flange;

said lower frame having a sidewall, a horizontal support flange, and a hollow interior, with said sidewall and said horizontal support flange being disposed within said hollow interior of said liner and with a portion of said lower frame mounted on said peripheral flange of said liner, said sidewall of said lower frame having an outer periphery corresponding to the interior periphery of said liner;

said intermediate frame having a hollow interior, a horizontal support surface, a vertical upwardly depending flange, and a vertical downwardly depending flange aligned with said upwardly depending flange, said aligned flanges defining the outer periphery of said intermediate frame and corresponding to the hollow interior of said lower frame, said intermediate frame being disposed within said hollow interior of said lower frame and supported by said height adjustment means above said horizontal support flange at a variable distance, said downwardly depending flange of said intermediate frame being located immediately adjacent said sidewall of said lower frame to prevent material from gaining ingress between said intermediate frame and said lower frame irrespective of said distance said intermediate frame is disposed over said lower frame;

said upper frame having an outer periphery corresponding to said hollow interior of said intermediate frame and being supported on said horizontal support surface within said hollow interior of said intermediate frame;

said cover plate being a generally planar member that is fixedly secured within said upper frame to form a first recess having a first depth on one side of said upper frame and a second recess having a second depth on the opposite side of said upper frame, with the depth of one of said recesses being greater than the depth of the other of said recesses, said upper frame and said cover plate being releasably mounted as a unit within the interior of said intermediate frame so that said upper frame and said cover plate can be inverted as a unit, whereupon either of said recesses can be directed upward to be immediately adjacent the floor covering, said upwardly-directed recess being arranged to receive a flooring panel of a thickness corresponding to the depth of the upwardly-directed recess, the flooring panel having a top surface; and, said height adjustment means being adjustable to adjust the distance that said intermediate frame is disposed above said horizontal support flange of said lower frame so that the top surface of the flooring panel is flush with the top surface of the floor covering.

2. The access pit assembly of claim 1 additionally comprising removal means for enabling said cover plate and said upper frame to be removed as a unit from said assembly.

3. The access pit assembly of claim 2 wherein said removal means comprises a groove in said upper frame and extending about the entire outer periphery of said upper frame between said outer periphery and the hollow interior of said intermediate frame.

4. The access pit assembly of claim 1 additionally comprising gasket means interposed between said support surface and said upper frame.

5. The access pit assembly of claim 1 wherein said height adjustment means comprises plural threaded members.

6. The access pit assembly of claim 5 wherein each of said plural threaded members comprises a head and wherein said intermediate frame includes a bottom surface having a groove in which the heads of said threaded members are located.

7. The access pit assembly of claim 1 wherein said cover plate includes a top surface and peripheral edge, and wherein said upper frame comprises a top surface and a bottom surface and a groove extending about the periphery of said hollow interior between said top surface and said bottom surface for receipt of said peripheral edge of said cover plate, whereupon with said cover plate located therein the top surface of said cover plate is located below said top surface of said upper frame to provide said shallow recess.

8. The access pit assembly of claim 1 wherein said pit is located within surrounding material and wherein said lower frame includes an upper horizontal flange and anchoring pins projecting diagonally away from said frame, said flange and said anchoring pins being disposed within said surrounding material for distributing any loads imposed on said cover plate to said surrounding material.

9. The access pit assembly of claim 1 wherein said liner comprises a portion of said assembly and wherein said liner includes a plurality of vertically oriented strengthening gussets.

10. The access pit assembly of claim 1 wherein said liner is water-tight.

* * * * *